US006095198A

United States Patent [19]

Debaes

[11] Patent Number: 6,095,198

[45] Date of Patent: Aug. 1, 2000

[54] METHOD FOR WEAVING A PILE FABRIC WITH HIGH PILE DENSITY

[75] Inventor: Johnny Debaes, Moorslede, Belgium

[73] Assignee: N.V. Michel Van de Wiele, Kortrijk/Marke, Belgium

[21] Appl. No.: 09/207,626

[22] Filed: Dec. 9, 1998

[51] Int. Cl.[7] ..... D03D 27/06

[52] U.S. Cl. ..... 139/398; 139/21

[58] Field of Search ..... 139/11, 20, 21, 139/27, 37, 46, 116.5, 291 C, 391, 392, 394, 397, 398, 404, 405, 407, 408, 440, 411, 412; D03D 27/06, 27/10

[56] References Cited

FOREIGN PATENT DOCUMENTS

| | | |
|---|---|---|
| 0 628 649 | 12/1994 | European Pat. Off. . |
| 745 059 | 5/1933 | France . |
| 4 303 273 | 12/1993 | Germany . |

*Primary Examiner*—John J. Calvert
*Assistant Examiner*—Robert H. Muromoto
*Attorney, Agent, or Firm*—James Creighton Wray; Meera P. Narasimhan

[57] ABSTRACT

A method for manufacturing a pile fabric whereby a backing fabric (9), (10) is woven, in which groups of at least three weft threads (1–4), (5–8) are inwoven into respective openings between binding warp threads (11), (12); (13), (14) crossing each other, and in which non-pile-forming (parts of) pile warp threads (15–19) and tension warp threads (20), (21) are woven in, while pile warp threads (15), (16), (19) are allowed to form pile loops around weft threads, and whereby of each group of weft threads a first (1), (3); (5), (7) and a second weft thread (2); (6) are provided respectively along the pile side and along the back of the tension warp threads (20); (21) and the non-pile-forming (parts of) pile warp threads (15–19), and a third weft thread (4); (8) is provided between on the one hand the tension warp threads (20); (21) and on the other hand the non-pile-forming (parts of) pile warp threads (15–19).

The weft threads (1–4); (5–8) of every group are woven in on three different levels in the backing fabrics, and can because of this be pushed one under the other. This makes a higher weft density and therefore also a higher pile row density possible.

11 Claims, 1 Drawing Sheet

METHOD FOR WEAVING A PILE FABRIC WITH HIGH PILE DENSITY

Figure 1:
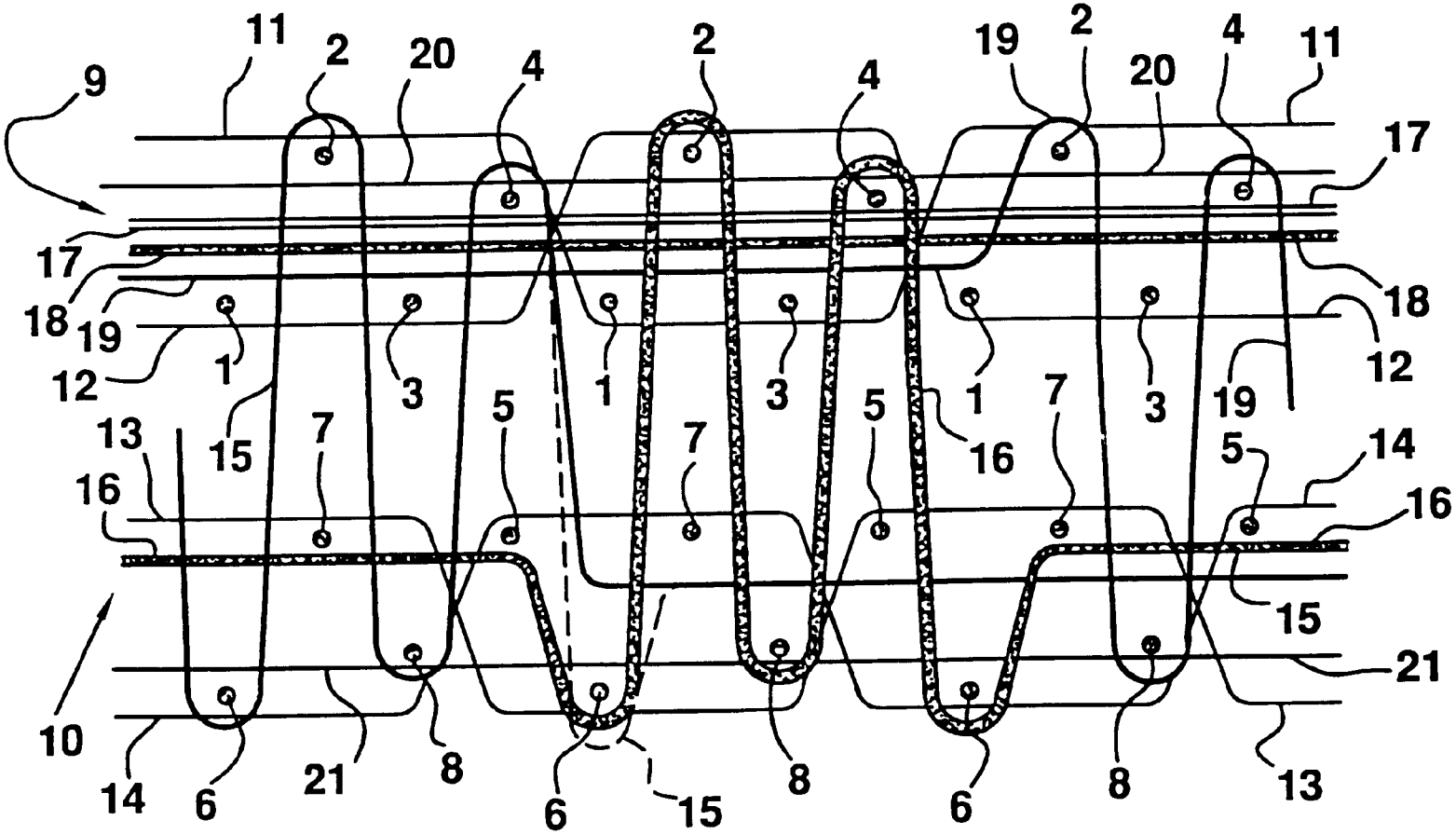

This invention relates to a method for manufacturing a pile fabric whereby a backing fabric is woven, in which groups of at least three weft threads are inwoven into respective openings between binding warp threads crossing each other, and in which non-pile-forming (parts of) pile warp threads and tension warp threads are woven in, while pile warp threads are allowed to form pile loops around weft threads.

This invention relates in particular to such a method for weaving pile fabrics with a high pile density, such as for example carpets.

For weaving carpets with a high pile density in the state-of-the-art the single gripper method and the double gripper method are known. These weaving methods have the characteristics mentioned in the first paragraph of this specification, but also have a number of deficiencies which we would first like to clarify in that which follows.

When weaving pile fabrics with a high pile density on the one hand a high reed density must be ensured and on the other hand a high pile row density must be obtainable. With the known methods a conventional high reed density is 500 to 512 per meter, while a pile row density from 8 to 10 per cm. can be achieved.

By using the single gripper method on a known weaving machine during every weft thread insertion cycle one weft thread is brought into a shed formed between warp threads. This method has the advantage that the pile warp threads can be allowed to form pile loops around each weft thread. One pile row per weft thread can therefore be achieved in the carpet. This method however has the disadvantage that it has a low productivity.

In order to achieve a higher productivity preference is often given to the double gripper method, whereby on a face-to-face weaving machine during every weft insertion cycle two weft threads can be inserted. If the pile-forming pile warp threads are allowed to form pile according to a two-shot weave in the backing fabrics formed one above the other there is also the advantage that the tufts of the pile loops are held more upright because of the fact that the pile loops can be formed around a weft thread located on the back, while the pile loop tufts on the pile side of the fabric are supported by weft threads located on both sides of every pile loop. The great disadvantage of this weaving method is however that pile fabrics are obtained with twice as many weft threads as pile rows. Between two pile loops in each case there indeed lies a weft thread which is not used for forming a pile row. These intermediate weft threads make it impossible to achieve a great pile row density in the pile fabrics.

If it is nevertheless attempted to obtain high pile row densities according to this method it will be ascertained that the non-pile-forming (parts of) pile warp threads have the tendency to form undesired loops on the back of the fabric.

The purpose of this invention is to provide a method, according to which a pile fabric with high pile density can be woven with a higher productivity than according to the known single gripper weaving method and without the disadvantages which are linked to the utilization of the known double gripper weaving method.

The above mentioned aim has been achieved according to this invention by providing a method with the characteristics mentioned in the first paragraph of this specification, whereby of each group of weft threads a first and a second weft thread are provided respectively along the pile side and along the back of the tension warp threads and the non-pile-forming (parts of) pile warp threads, and a third weft thread is provided between on the one hand the tension warp threads and on the other hand the non-pile-forming (parts of) pile warp threads.

By weaving according to this method the weft threads of each group are inwoven into the backing fabric on three different levels. The weft threads of one and the same group are in each case in one and the same opening between crossing binding warp threads. The weft threads of each group can consequently, when they are pushed toward one another, come into a position whereby they more or less lie under one another. Because of this a higher weft density (=number of weft threads per meter of fabric), and consequently also a higher pile row density can be obtained in the pile fabric.

By utilizing this method two weft threads can be inserted in each weft insertion cycle, and for example pile warp threads also interlaced according to a two-shot weave, while a pile fabric with a very high pile row density and without undesired loops on the back can be weaved.

With the implementation of this method use can therefore be made of the double gripper weaving method, which is much more productive than the known single gripper weaving method, while a pile fabric can be manufactured that has a considerably higher pile density than has been possible up until now with the double gripper weaving method.

With the method according to this invention the pile-forming pile warp threads are preferably allowed to form pile loops alternately around a second and a third weft thread of the backing fabric. According to this method a pile fabric is obtained in which the pile loops of the successive pile rows are alternately woven through around a weft thread located on the back and are not woven through around a weft thread which extends between the non-pile-forming (parts of) pile warp threads and the tension warp threads. In that manner the pattern formed by the pile still remains well visible along the back of the pile fabric. Furthermore the pile warp yarn consumption is reduced because of this.

With this method the pile-forming pile warp threads are preferably allowed to form pile according to a two-shot weave. By utilizing a two-shot weave the pile loop tufts are held well upright.

A number of known methods have the disadvantage that the colors of these non-pile-forming (parts of) pile warp threads show through along the back of the pile fabric.

The above mentioned disadvantage is efficiently remedied with the method according to this invention by so weaving the tension warp threads into the backing fabric that they extend along the back of the third weft threads, and by so weaving the non-pile-forming (parts of) pile warp threads into the backing fabric that they extend along the pile side of the third weft threads.

The backing fabric is in very preferred manner so woven that every group of weft threads comprises two first, one second and one third weft thread, while the two first weft threads of each group are inserted between warp threads respectively prior to and after the insertion of the second weft thread of their group. If the pile loops are formed around the second and/or third weft threads, a first weft thread located along the pile side can be provided on both sides of each pile loop. In that manner the pile loop tufts are laterally very well supported by these first weft threads and pile loops with well upright standing pile tufts are obtained.

Furthermore preference is given to the implementation of this method on a face-to-face weaving machine, whereby a top and a bottom backing fabric is woven, while pile-forming pile warp threads are alternately interlaced over a weft thread in the top and the bottom backing fabric, and whereby these pile-forming pile warp threads are cut through between the two backing fabrics in order to obtain two pile fabrics.

If the face-to-face weaving machine is also furthermore provided for inserting two weft threads one above the other in one and the same insertion cycle, and if during successive insertion cycles in each case a weft thread is inserted for the top backing fabric and a weft thread for the bottom backing fabric, pile fabrics with great pile density can be woven very productively.

A very preferred pile fabric with high pile density is obtained if the insertion of a first weft thread in one of the backing fabrics takes place during the same insertion cycle as the insertion of a second or a third weft thread in the other backing fabric.

In order to obtain two almost identical pile fabrics on a face-to-face weaving machine the non-pile-forming (parts of) pile warp threads are preferable divided over the top and the bottom backing fabric inwoven in these backing fabrics.

This invention obviously also relates to a pile fabric that is manufactured according to the method according to this invention.

Pile fabrics are known with a backing fabric in which groups of at least three weft threads are inwoven into respective openings between binding warp threads crossing each other, and in which non-pile-forming (parts of) pile warp threads and tension warp threads are inwoven, and with pile threads which form pile loops around weft threads. The deficiencies of such fabrics with a high pile density follow from the above description of the state-of-the-art.

These disadvantages are remedied if the pile fabric is so made that in every group of weft threads a first and a second weft thread are provided respectively along the pile side and along the back of the tension warp threads and the non-pile-forming (parts of) pile warp threads, while a third weft thread is provided between on the one hand the tension warp threads and on the other hand the non-pile-forming (parts of) pile warp threads. Such a fabric can have a very high weft density because the weft threads of every group are woven in on three different levels and therefore lie more or less under one another. Because of this such a fabric can also have a very high pile row density.

This invention enables among others carpets with a very high pile density to be manufactured on a weaving machine with a high productivity. The mechanical weaving of carpets of good quality with a pile row density which is greater than for example 10 per cm. can now be performed without any problem.

This invention is further explained in the following more detailed specification of a possible method according to this invention and of a fabric manufactured according to this invention. This specification may in no way be interpreted as restrictive to the protection claimed for this invention. In the specification reference is made to the drawings attached hereto, in which FIG. 1 represents a schematic cross-section, according to the direction of the warp threads, of a carpet with high pile row density woven according to this invention.

According to this invention a carpet with a high pile density can be woven on a face-to-face weaving machine with two gripper systems which are provided for each inserting a weft thread (1), (6); (2), (7); (3), (8); (4), (5) almost simultaneously during one and the same insertion cycle.

These weft threads are inserted between binding warp threads (11), (12); (13), (14), tension warp threads (20); (21), and pile warp threads (15–19) which are provided on the weaving machine and can be positioned prior to every insertion of weft threads, for example by a jacquard machine, in order to weave a top (9) backing fabric and a bottom backing fabric (10) with weft threads (1–4); (5–8) woven in by respective binding warp threads (11), (12); (13), (14), and with tension warp threads (20), (21) and non-pile-forming (parts of) pile warp threads (15–19) inwoven into the backing fabric (9); (10), and in order to interlace pile warp threads (15), (16), (19) alternately in the top (9) and the bottom backing fabric (10) over weft threads (1–4); (5–8) in order to form pile loops. The pile-forming pile warp threads (15), (16), (19) are subsequently cut through between the two backing fabrics (9), (10) in order to obtain two carpets.

In a number of systems of warp threads (11–21) located one next to the other two binding warp threads (11), (12) and a tension warp thread (20) for the top backing fabric (9), two binding warp threads (13), (14) and a tension warp thread (21) for the bottom backing fabric (10), and pile warp threads (15–19) are provided.

The binding warp threads (11), (12); (13), (14) of each backing fabric (9), (10) are so positioned that they cross each other after four weft insertion cycles. In that manner in each backing fabric (9), (10) in each case a group of four weft threads (1–4), (5–8) is inwoven together into one and the same opening between crossing binding warp threads (11), (12); (13), (14).

The non-pile-forming (parts) of pile warp threads (15–19) are divided over the two backing fabrics inwoven into these backing fabrics (9), (10). The tension warp threads (20), (21) and the non-pile-forming (parts of) pile warp threads (15–19) are so positioned during the successive weft insertion cycles that the four weft threads (1–4); (5–8) inserted one after the other of each group in each fabric (9), (10) have the following positions in relation to these warp threads (15–21):

The weft threads (1), (3); (5), (7) inserted as first and third of this group are along the pile side in relation to the tension warp threads (20); (21) and the non-pile-forming (parts of) pile warp threads (15–19). (In the specification introduction and in the claims both weft threads are called "the first weft threads").

The weft thread (2); (6) inserted as second of this group is along the back in relation to the tension warp threads (20); (21) and the non-pile-forming (parts of) pile warp threads (15–19). (In the specification introduction and in the claims this weft thread is called "the second weft thread").

The weft thread (4); (8) inserted as fourth of this group is between on the one hand the tension warp threads (20); (21) and on the other hand the non-pile-forming (parts of) pile warp threads (15–19). (In the specification introduction and in the claims this weft thread is called "the third weft thread").

During every weft insertion cycle a weft thread (1–4) is inserted for the top fabric (9) and a weft thread (5–8) for the bottom fabric (10). The crossing of the binding warp threads (11), (12) of the top backing fabric (9) in each case occurs one weft insertion cycle earlier than the crossing of the binding warp threads (13), (14) of the bottom backing fabric (10). Each weft thread (1) which is inserted in the top backing fabric (9) as first of a group, is therefore inserted together with a weft thread (6) which is inserted in the bottom backing fabric (10) as second of a group. Thus the weft threads inserted in the top backing fabric (9) as second (2), as third (3) and as fourth (4) of a group are inserted together with the weft threads inserted in the bottom backing fabric (10) respectively as third (7), as fourth (8) and as first (5) of a group. In the figure the weft threads (1), (6); (2), (7); (3), (8); (4), (5) inserted together are represented one under the other.

The pile-forming pile warp threads (15), (16), (19) are alternately interlaced in the top (9) and the bottom backing fabric (10) according to a two-shot weave. In both backing fabrics (9), (10) these pile warp threads alternately form a pile loop around a weft thread (2), (6) (called "a second weft thread" in the claims) extending along the back of the tension warp threads (20), (21) and the non-pile-forming (parts of) pile warp threads (15–19) and around a weft thread (4), (8) (called "a third weft thread" in the claims) extending between the tension warp threads (20), (21) and the non-pile-forming (parts of) pile warp threads (15–19). Thus a through-woven and a non-through-woven pile loop is alternately obtained in each pile fabric. Because of this the pattern formed by the pile loops remains clearly visible on the back of the pile fabric, while a reduced pile warp yarn consumption is achieved.

In order to obtain a carpet with a very high pile density a reed density of 512 per meter is provided. By utilizing the weave described above and represented in the figure, 27 weft threads can be inserted per centimeter, which produces a pile row density of 13.5 per centimeter.

This is possible because of the fact that the weft threads (1–4); (5–8) of every group are woven in on three different levels and furthermore extend in one and the same opening between crossing binding warp threads (11), (12); (13), (14). Because of this the weft threads are pushed one above the other, so that a higher weft density, and therefore also a higher pile row density is achieved.

The non-pile-forming (parts of) pile warp threads (15–19) are divided over the top (9) and the bottom backing (10) fabric inwoven in these backing fabrics, and are in relation to the tension warp threads (20), (21) and two weft threads (2), (4); (6), (8) per group along the pile side, so that the colors of these pile warp threads (15–19) cannot show through on the back of the pile fabrics.

In order to avoid mixed contours in the pile fabrics the measures known for that purpose can also be taken with this method. Mixed contours are for example obtained in those places where the pile formation of a first pile warp thread (15) is stopped and is immediately followed by the pile formation of a second pile warp thread (16), while the non-pile-forming parts of the first (15) and the second pile warp thread (16), are inserted respectively before and after the pile change in the bottom backing fabric (10). The last pile tuft of the first pile warp thread (15) in the bottom fabric (10) and the first pile tuft of the second pile warp thread (16) in the bottom fabric (10) are inwoven between the two same weft threads (6), (7), and cause mixed contours. In order to prevent this the first pile warp thread (15) is provided under the first (6) of these two weft threads, so that this pile warp thread (15) acquires the path indicated by dashed line in FIG. 1.

What is claimed is:

1. A method for manufacturing a pile fabric comprising a woven backing fabric, plural pile, tension and binding warp threads crossing each other, weaving plural groups of weft threads with each group having at least three weft threads woven into respective openings between the plural binding warp threads, weaving in non-pile-forming parts of the pile warp threads and the tension warp threads, forming pile loops around the weft threads with the pile warp threads, providing a first and a second weft thread of each group of the weft threads respectively along a pile side and along a back side of the tension warp threads and providing the non-pile-forming parts of the pile warp threads and a third weft thread of each group between the tension warp threads and the non-pile-forming parts of pile warp threads.

2. The method of claim 1, wherein forming the pile loops comprises forming loops alternately around the second and the third weft thread with the pile-forming parts of the pile warp threads of the backing fabric.

3. The method of claim 1, wherein forming the pile loops comprises forming loops with the pile-forming pile warp threads according to a two-shot weave.

4. The method of claim 1, further comprising weaving the tension warp threads into the backing fabric thereby extending the tension warp threads along a back side of the third weft threads and weaving the non-pile-forming parts of the pile warp threads into the backing fabric thereby extending the non-pile-forming parts along the pile side of the third weft threads.

5. The method of claim 1, wherein the weaving of the backing fabric comprises weaving with every group of the weft threads comprising two first weft thread, one second weft thread and one third weft thread and wherein the two first weft threads of each group are inserted between the plural warp threads respectively prior to and after insertion of the second weft thread of the respective group.

6. The method of claim 1, further comprising a top backing fabric and a bottom backing fabric, wherein the pile-forming pile warp threads are alternately interlaced over a weft thread in the top backing fabric and the bottom backing fabric, and wherein the pile-forming pile warp threads are cut through between the top and the bottom backing fabrics thereby obtaining two pile fabrics.

7. The method of claim 6, further comprising inserting two weft threads one above another in one insertion cycle, and inserting in successive insertion cycles a weft thread in the top backing fabric and a weft thread in the bottom backing fabric.

8. The method of claim 7, wherein the inserting of a first weft thread in one of the backing fabrics occurs during the same insertion cycle as the inserting of a second or a third weft thread in the other backing fabric.

9. The method of claim 8, wherein the is non-pile-forming parts of the pile warp threads are divided over the top and the bottom backing fabrics and inwoven in the backing fabrics.

10. Pile fabric with a backing fabric comprising groups of at least three weft threads inwoven into respective openings between binding warp threads crossing each other, non-pile-forming parts of pile warp threads and tension warp threads being woven in, pile threads forming pile loops around weft threads, every group of weft threads having a first and a second weft thread positioned respectively along a pile side and along a back side of the tension warp threads and the non-pile-forming parts of pile warp threads, and a third weft thread provided between the tension warp threads and the non-pile-forming parts of pile warp threads.

11. The pile fabric of claim 10, wherein the pile fabric is a carpet with a pile density greater than 10 per cm.

* * * * *